US005735418A

United States Patent [19]

Erb et al.

[11] Patent Number: 5,735,418

[45] Date of Patent: Apr. 7, 1998

[54] CLOSING DEVICE FOR CONTAINER

[75] Inventors: Hermann Erb, Fussgönnheim; Stephan Sattler, Peissenberg; Albert Wohland, Viernheim, all of Germany

[73] Assignee: Boehringer Mannheim GmbH, Mannheim, Germany

[21] Appl. No.: 457,436

[22] Filed: Jun. 1, 1995

[30] Foreign Application Priority Data

Jun. 1, 1994 [DE] Germany ..... 44 19 116.2

[51] Int. Cl.[6] ..... B65D 43/16

[52] U.S. Cl. ..... 215/237; 215/235; 220/254; 220/335; 220/339

[58] Field of Search ..... 215/235, 237, 215/244; 220/254, 335, 337, 339

[56] References Cited

U.S. PATENT DOCUMENTS

| | | | |
|---|---|---|---|
| 4,010,875 | 3/1977 | Babiol | 215/235 X |
| 4,158,902 | 6/1979 | Chernack et al. | 16/150 |
| 4,172,540 | 10/1979 | Erichson | 222/517 |
| 4,291,818 | 9/1981 | Nozawa et al. | 220/335 |
| 4,346,810 | 8/1982 | Kneissl | 215/237 |
| 4,377,247 | 3/1983 | Hazard et al. . | |
| 4,573,600 | 3/1986 | Dubach | 215/237 |
| 5,088,612 | 2/1992 | Storar et al. | 215/247 |
| 5,368,176 | 11/1994 | Thanisch . | |

FOREIGN PATENT DOCUMENTS

| | | | |
|---|---|---|---|
| A-0 04 570 | 1/1982 | European Pat. Off. . | |
| 538572 | 8/1992 | European Pat. Off. | 215/235 |
| A-26 01 989 | 7/1976 | Germany . | |
| 85 36 556.4 | 12/1985 | Germany . | |
| A-39 06 570 | 9/1990 | Germany . | |
| 41 23 732 A1 | 1/1992 | Germany . | |
| 57-199546 | 6/1982 | Japan . | |
| 62-171452 | 10/1987 | Japan . | |
| 63-40351 | 3/1988 | Japan . | |
| WO 93/159063 | 8/1993 | WIPO . | |
| WO 94/04427 | 3/1994 | WIPO . | |

*Primary Examiner*—Stephen Cronin

*Attorney, Agent, or Firm*—Nikaido, Marmelstein, Murray & Oram LLP

[57] ABSTRACT

A closing device for containers is made of plastic with a tiltable lid linked to a lid support to be attached to the lid or to the container where it can be moved via a hinged connection from a closed position to an open position. The closing device also has a spring on one side of the lid, and a lid support or the container on the other side. The spring is arranged with respect to the tilting axis of the lid which is defined by the hinged connection such that the lid is displaced from the closed position to the open position after having passed a dead center position, due to the pre-stress of the spring. The lid and the lid support or container each have at least one integrally linked abutment. The abutments come into contact with each other in the open position of the lid as a result of being urged into the contact position by the spring.

22 Claims, 8 Drawing Sheets

CLOSING DEVICE FOR CONTAINER

BACKGROUND OF THE INVENTION

1. Field of the Invention

The invention relates to a closing device made of plastic comprising a tiltable lid which is attached via at least one hinged connection to a lid support to be positioned on the container or is attached to the container itself where it can be tilted from a closed position into an open position. In addition, provision is made for a spring which contacts the lid, on the one side, and the lid support and/or the container itself, on the other side. Said spring is arranged relative to the hinged connection, which is defined by the tilting axis of the lid, such that owing to the prestress of the spring, the lid when tilted is urged from its closed position into its open position after passing through a dead-center position.

2. Description of the Related Art

Such plastic closing devices for containers where the actual lid is attached to a support mounted to the neck of the container via a hinged connection which preferably consists of one pliable hinge are commonly used as a closing means for containers, e.g. for liquid detergents, domestic cleaners and the like, as they are inexpensive to produce. Owing to special configurations of the injection molds for such closing devices and special molding techniques, the actual lid is injected in a plastic mold in a position where it is opened by 180° and then automatically moved into the closed position before or during ejection from the mold. It is thus even possible to integrate during the molding process a spring to the lid, on the one side, and the lid support, on the other side, in addition to a certain already given elasticity of the plastic material of the lid. Said spring exerts a prestress to the lid to assume its closed position, while reversing its action when the lid is opened so as to urge the lid in the opening direction until it is fully opened after a certain tilting movement has been carried out (e.g. EP 0 517 092, FIGS. 17–21; DE-39 06 570 A1). However, in such closing devices for containers, the open position is not exactly defined, i.e. the exact angle which the lid assumes in the open position relative to the lid support as a consequence of the action of the spring cannot be exactly predicted. It is indeed possible to have variations of the molded closing devices when different lots of the initial plastic granulate is used which may have different elasticity properties or varying cooling rates. In certain uses and applications, however, the exact open position of the container closing device may be of particular importance. If containers that are to be provided with closing devices are automatically filled with larger amounts of a medium in correspondingly automated systems and then closed, while filling or removing pipettes are automatically entered and retracted through the open lid, it is important that the open lid assumes a defined position. This condition is particularly imperative when several juxtaposed containers are stepwise and successively supplied via automated conveyors and the filling and removing pipettes are entered into and retracted from the container. Once the conveying step is completed, this procedure must be repeated. It is obvious that a lid which is not sufficiently opened or opened too wide may interfere with the movement of the filling or removing pipette in the corresponding container or the next following container resulting in a malfunction. In the particular case when the containers serve as analysis containers to hold highly infectious material to which additional reagent or the like has to be added, the correct alignment of the open lid in a position in which a malfunction of the automated system is definitely excluded becomes absolutely necessary as working with such infections material does not allow monitoring and handling by staff members. In a closing device where a yielding, flexible clip connects the lid to its support, it is known (DE 26 01 981 A1) to provide elastic resilient abutments at the lid and the lid support. Said abutments contact one another when the closing device of a liquid-filled container is held in a open position, i.e. with the closing device facing downward, thus preventing the lid from swinging into the beam of medium emerging from the container which would then interfere with the pouring. The abutments of the lid are not fixed in their positions when the abutments are in contact with each other. When the container is turned the lid assumes the completely open position as the clip is extremely flexible

SUMMARY OF THE INVENTION

The invention is based on the object of providing a closing device of the type mentioned where a spring device causes the lid to swing into an exactly defined, pre-set open position when a given opening angle is passed.

Based on a closing device of the above mentioned type, this object is accomplished in that at least one integrated stopping element in the form of an abutment is provided at both the tiltable lid and the lid support and/or the container itself. Said abutment projects from the lid, on the one side, and the lid corresponding support or the container itself, on the other side. The abutments have surfaces which contact each other in a given open position of the lid and are urged against one another due to the action of a spring acting at the lid. Preferentially at least one of the abutments has an elastic configuration such that when the lid is closed for the first time, the respective abutment at the other tiltable part urges it in a flexible manner out of an open position which is beyond the desired open position. After reaching the open position, it springs back into the desired position with the surfaces contacting each other. It is thus possible to favorably manufacture the closing device by means of injection molding where the lid of the closing device is integrated by injection with the lid opened by 180° position. When the lid is closed upon ejection from the mold, the abutments now provided with contact surfaces can during closing project pass each other due to the elasticity of at least one of these abutments. When the elastically displaced abutments spring back, the contact surfaces which secure the lid in the given open position in accordance with the object act at the abutment. The lid can now only be moved between the completely closed position and the desired open position, whereby the configuration and the position of the spring ensure bistability, i.e. fixing the lid in its respective end position.

As shown in prior art, the hinged connection preferably comprises a pliable hinge which integrally connects at least the lid and the lid support or container.

Although it is basically possible to use at least one separately manufactured and mounted spring, the improvement in accordance with the invention proposes that the spring be a spring which is integrally attached to at least one of the parts which are linked to each other via the hinged connection.

In a first embodiment of the invention, the configuration such that at least one contact surface is provided at the lower side of a hook type bend of the one or several abutments.

The elastically configured abutment(s) provided with said bend are preferably provided at the lid support or the container so that the other abutment provided at the lid may be given a more rigid configuration.

At the upper side opposite the contact surface, the one or several abutments with the bend are advantageously provided with a rounded contour which is located in the area which, during closing, comes to rest against the respective abutment at the other one of the parts which can be tilted with respect to each other. Said contour facilitates the movement of the more rigid abutment passed the elastic abutment with the bend without the risk of damaging the abutments.

The one or several abutments which have no bend may have a rounded contour in the end area, which comes to rest against a respective abutment which does have an angle portion when the lid is closed from its actual position which is beyond the desired open position.

Advantageously, the one or several contact surfaces formed at the lower side of the bend run perpendicularly to the bending plane of the respective flexible abutment. This ensures that the prestress force of the bending spring, which presses the contact surfaces at the abutments in the open position against each other, does not exhibit a force component that causes the contact surfaces to disengage as a consequence of an elastic deformation of the elastic abutments.

In an alternative embodiment of the invention, the abutment projecting from the lid may be formed such that it exhibits a high bending resistance while the abutment projecting from the lid support or the container itself is flexible. The interacting contact surfaces which are formed at the abutments are arranged such that a force, acting upon the lid so as to swing the latter beyond a given open position further in opening direction, generates a reactive force which runs essentially perpendicularly to the contact surfaces. Since this reactive force runs a normal direction with respect to the contact surfaces, it cannot cause a bending of the elastic abutment. An erroneous swinging of the lid passed the given open position is thus prevented.

The abutment projecting from the lid is advantageously provided with a reinforcing rib to prevent bending and has, at its end facing away from the lid, a short projection carrying the contact surfaces. The abutment projecting from the lid support or the container itself has the form of two spaced-apart rod-like portions which can be bent in their longitudinal extension. The free ends of these portions are connected via a cross bar at the lower side of which the contact surface is formed. The internal width taken between the rod-like portions of the abutment projecting from the lid support or the container itself is then advantageously about the same or slightly larger than then widths of the projection protruding from the abutment of the lid.

In order to provide an elastic bending of the abutment projecting from the lid support or the container itself when the lid is tilted for the first time after manufacture in the ejection mold in direction toward the closed position, it is recommended that the surface areas of the projection and the cross bar, which come to rest against each other when approaching the given lid open position during closing of the lid from a given open position, be formed such that a force acting on the lid in closing direction generates in this surface area a reactive force which bends the rod-like portions of the abutment projecting from the lid support or the container itself.

When the opened containers are filled from the top, tubes or nozzles are introduced which affect the filling or adding of reagent, the preferred embodiment is one where the contact surfaces, which are in contact in open position, are arranged such that a desired open position can be kept exactly. Preferentially the lid, with respect to its fully closed position, faces upward by an angle in the range of 80°–100°, preferably by 90°.

To make sure that the closing device in accordance with the invention tightly seals the container after filling and all possible subsequent steps, it is recommended that a stopper-like abutment be provided at the lower side of the lid facing toward the container. This stopper-like abutment fittingly engages in the closed position the opening of a though-hole in the lid support or the container itself in a known manner, thus tightly sealing the opening.

The stopper-like abutment preferably has the form of an annular wall which at its outer contour has a slightly spherical configuration at least in a partial area. The through-hole is configured in an annular wall in the lid support. The internal inner diameter thereof is provided with slightly excessive dimensions with respect to the outer diameter of the spherical partial area of the annular wall of the lid forming the stopper-like abutment. When the lid is closed, this ensures that the stopper-like abutment tightly closes the through-hole in the lid support. On the other hand, the spherical annular wall already seals the through-hole in the lid support already sufficiently against evaporation of liquid contained in the container when the lid is not yet fully closed, but only rests on the lid support. Since the lid is urged by the spring onto the lid support this position effectively prevents evaporation of liquids. When closing devices with such tilting lids are used for containers in analyzers, a tilting lid is only hinged down, for example during transport between the individual stations, in order to avoid evaporation of container content and minimize the force necessary to open the lid again at the next station.

The end portion of the annular wall which is provided at the lid support and faces the lid, is advantageously enlarged toward its free end to facilitate the introduction of the stopper-like abutment when the lid is closed. The internal width of the annular wall or the through-hole opening on the lid is sufficiently large to allow the introduction of lab pipettes and/or longitudinal tube-like filling tools. The internal width should be at least 8 mm, preferably at least 10 mm.

Thermoplastic materials for the stopper for the closing device in accordance with the invention are polyethylene, polypropylene, polyoximethylene, polyethylenterephthalate, polybutylenterphthalate, and styrene butadene copolymers. The use of polypropylene is currently preferred.

In a first embodiment, the spring assumes the form of an arc-like bent leaf spring after cooling in the mold where it is not exposed to stress. The one end of said leaf spring is integrally molded to the lid and the other end thereof to the lid support or the container itself. When not exposed to stress, said leaf spring preferably extends over an arc covering about 180°.

With respect to the tilting axis of the lid, the arc of the leaf spring is arranged such that a tilting movement in closing direction of the lid reduces the curvature of the arc at least in a first part of the closing movement. The leaf spring then tends to re-assume the arc-like bent form thus urging the lid into the desired open position until the contact elements rest against each other.

Instead of having one single spring, it is also possible to have two laterally spaced apart springs which are arranged at the same distance on opposing sites of a vertical plane of symmetry which runs perpendicularly to the tilting axis of the lid across the closing device.

Experience has shown that when the spring(s) of the above-mentioned embodiment have an average radius of approximately 1.2 mm, a thickness of approximately 0.4 mm and a total width of approximately 3 mm, there is still a sufficiently strong springiness acting in opening direction.

In an alternative embodiment, the spring has the form of a bend consisting of two essentially flat arms. These arms form an angle with respect to each other along a common edge and are integrally joint to each other. With their free edges which are opposite the common integral edge, said arms are integrally molded to the lid, on the one hand, or the lid support or the container itself, on the other hand, via a pliable hinged connection.

BRIEF DESCRIPTION OF THE DRAWINGS

In the following descriptions, three embodiments show the invention in greater detail with respect to a drawing, wherein:

FIG. 6*a* corresponds to the lid position of FIG. 3 and FIG. 6*e* shows the lid position just before reaching the fully closed position (FIG. 4). FIGS. 6*b* to 6*c* show positions therebetween with FIG. 6*c* showing the desired open position of the lid;

DETAILED DESCRIPTION OF THE PREFERRED EMBODIMENTS

Figure 1:
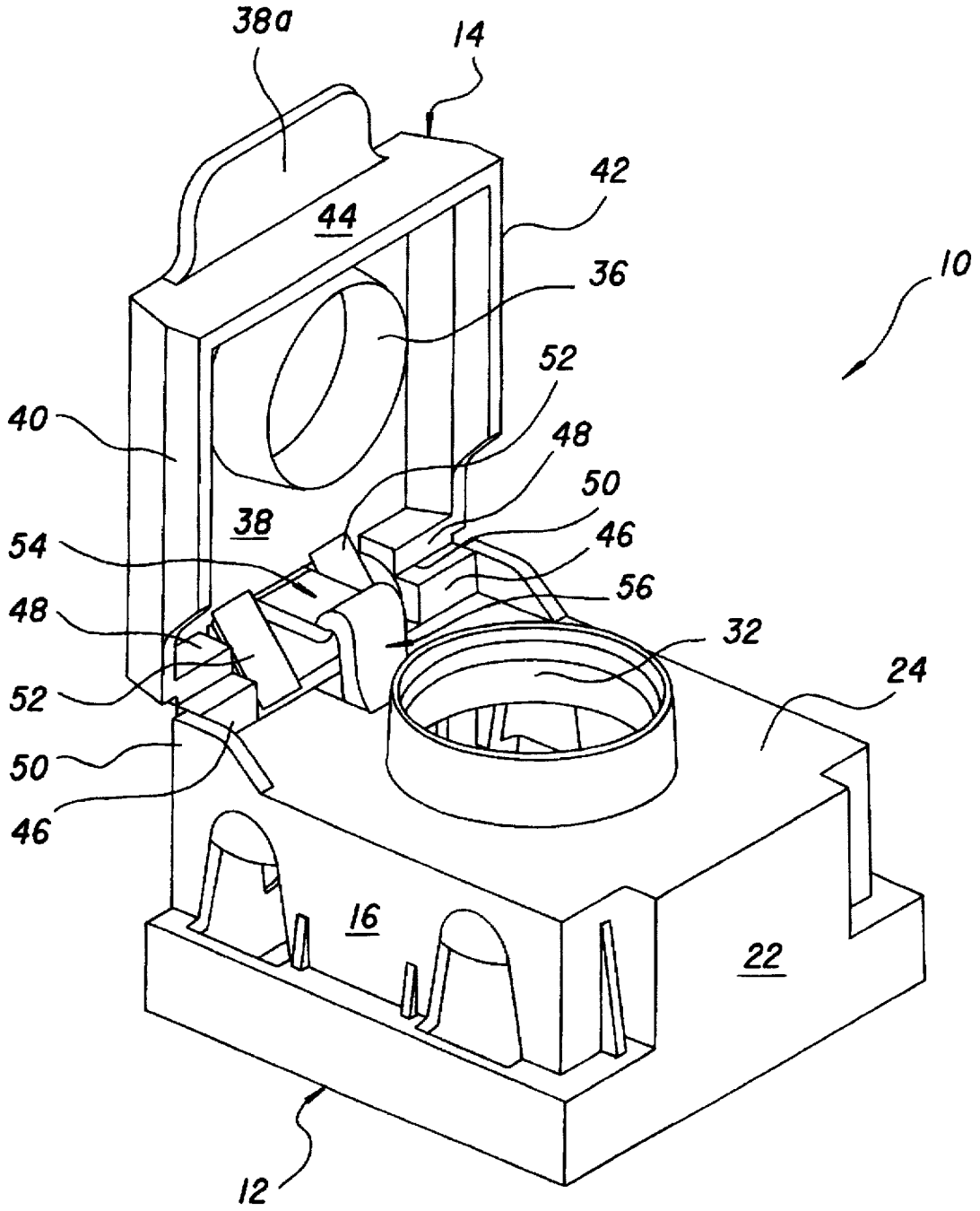
FIG. 1 is a perspective view of a first embodiment of a closing device for a container in accordance with the invention, where the lid is tilted open into the desired open position.
Figure 3:
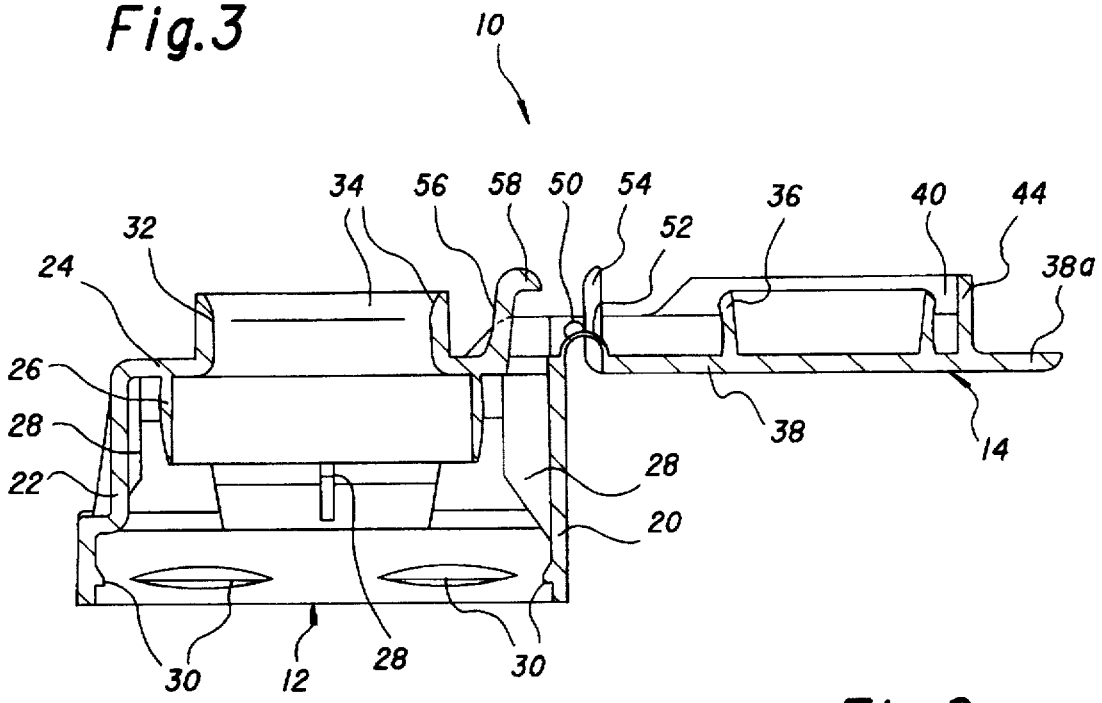
FIG. 3 is a sectional view of the closing device with the section taken in direction of the arrows 3—3 of FIG. 2.
Figure 2:
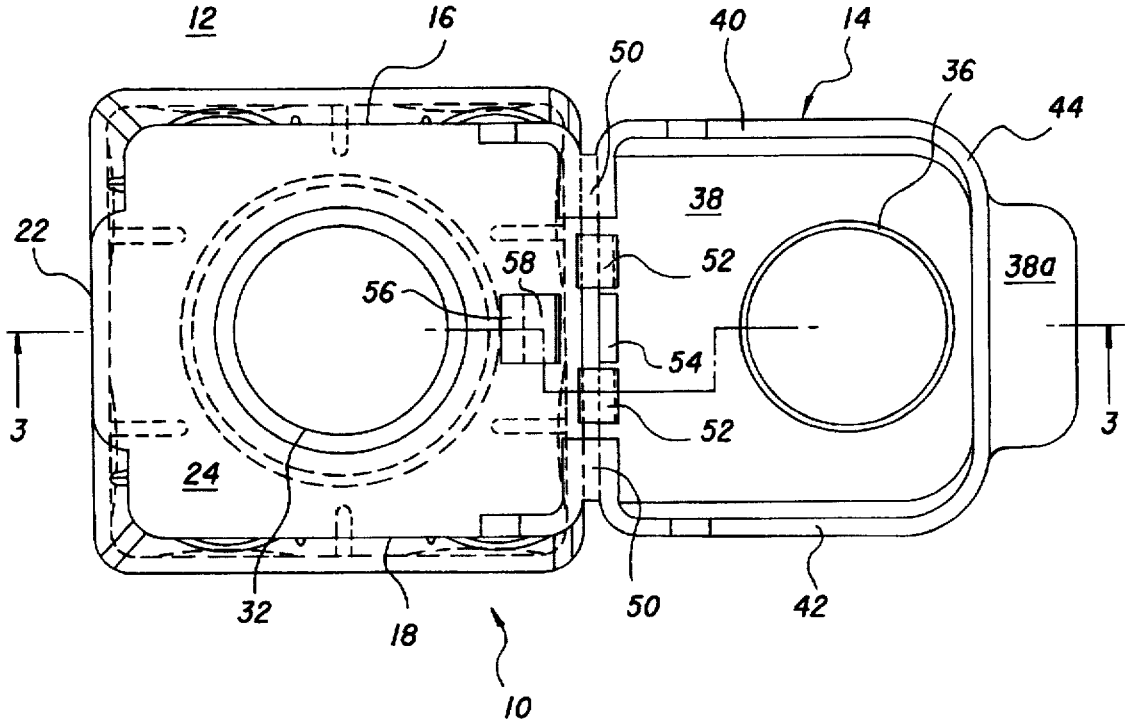
FIG. 2 is a top view of the closing device of the container of FIG. 1, where the injection-molded lid is shown in an open position which is beyond the desired open position, i.e. tilted up by 180° as compared to the closed position.

FIGS. 1 to 6 show an embodiment of a closing device for a container in accordance with the invention as an integral injection-molded part made of plastic. This embodiment is in its entirety designated with the reference numeral 10. It comprises two connected main components. One component is a lid support 12 which can be firmly attached to a container that is not shown. The second component is a lid 14 linked to lid support 12. In the present embodiment, the closing device 10 is designed for containers which, in a horizontal section, are approximately square-like. At their top sides, these containers have a section whose outer dimensions are smaller to snap on the lid support 12, and, like a bottle, form a cylindrical opening. In this particular case, the square-like cross section of the actual container was chosen to ensure place-saving and stable positioning of several containers in larger units. The planar contact of the container walls which are placed next to each other and in rows also ensures a defined distance between adjacent container openings in the larger units. The special configuration of the container is, however, not subject matter of the present invention. A description of the container configuration in greater detail is therefore omitted.

The lower side of lid support 12 which is snapped onto the smaller top of a corresponding container has essentially two vertical side walls 16, 18, a back wall 20 and a front wall 22 which are closed at the top by an essentially planar covering wall 24. In a top view, a circularly limited annular wall 26 projects from the lower side of covering wall 24. At its lower side, this annular wall 26 forms an open stopper which is pressed into the opening of the corresponding container when the lid support is mounted thereon. Owing to the fact that the outer diameter of the annular wall slightly exceeds the internal cross section of the cylindrical opening of the container and due to the slightly spherical contour of the outer wall, the annular wall 26 seals the lid support with respect to the container opening after assembly. The inner sides of side walls 16, 18 and the front and back wall 20, 22, respectively, have projecting ribs 28 which are bevelled at their respective lower ends which face toward the container. During assembly on the container, these ribs guide the lid support 12 such that the annular wall 26 is automatically aligned with respect to the container opening when placed thereon thus being secured against horizontal displacement after mounting of lid support 12. Moreover, the lower portion is provided with projections 30 which protrude from the inner sides of side walls 16, 18 and the front and back walls 22, 20, respectively. These projections snap in corresponding recesses or circumferential grooves in the container to secure the lid support against undesired removal from the container.

Another essentially cylindrical annular wall 32 projects from the top side of covering wall 24. The diameter of said annular wall 32 is smaller than the diameter of annular wall 26 to be mounted in the opening of the container. The covering wall is interrupted inside the annular wall 32, i.e. annular wall 32 provides openings necessary for the introduction of pipettes or nozzles into the container which is closed with closing device 10.

In the area of the upper free edge of annular wall 32, the essentially cylindrical inner surface of annular wall 32 conically expands at point 34. It thus forms a slanted guide for a stopper of lid 14 which is also configured as an annular wall 36 and engages the inside of annular wall 32. It is described in greater detail hereinafter.

Lid 14 as a planar wall 38 which essentially corresponds to the dimensions of wall 24 of lid support 12. From the edges of this wall 38 which are associated with the side walls 16, 18 and the front wall 22 of the support 12, strip-like wall sections 40, 42, and 44 project in direction toward the lid support. In the closed position of lid 14, the free edges of these wall sections (FIGS. 4 and 5) rest on wall 24 of lid support 12 thus acting as contact surfaces for the closed position of the lid. In the area of the front wall 22, lid wall 38, in its middle section, slightly exceeds wall section 44. The so-formed part 38*a* serves as a handle to open lid 14. When the lid is closed, annular wall 36 which forms the closing stopper engages annular wall 32 of the lid support 12. Owing to a correspondingly given outer diameter of annular wall 36 and the internal inner diameter of annular wall 32, the part of annular wall 36 which has a slightly spherical outer contour is exposed to an elastic prestress at annular wall 32. When lid 14 is fully closed, said spherical part tightly closes the through-hole inside the annular walls 32 and 26 of the lid support 12 which leads into the inside of the container to prevent contents from emerging from the closed container. If, however, lid 14 is only tilted down on lid support 12, the sealing will still be sufficiently tight to prevent evaporation of the liquid in the container.

Figure 5:
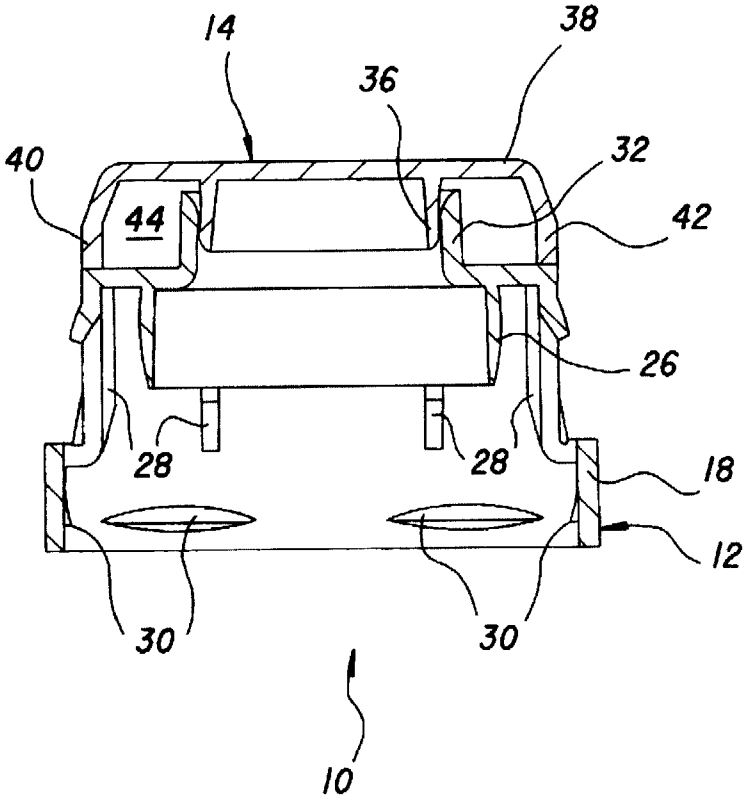
FIG. 5 is yet another sectional view, with the section taken in direction of arrows 5—5 in FIG. 4.
Figure 4:
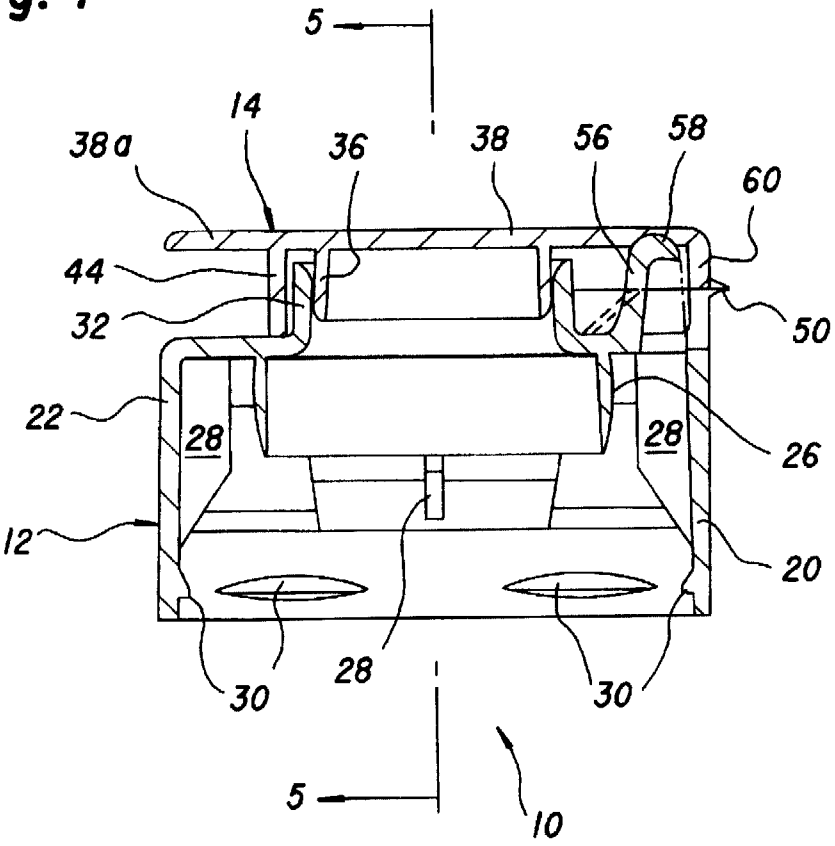
FIG. 4 is also a sectional view taken along the section of FIG. 3 in which the lid is tilted down into its closed position.

In order to ensure that the link between lid 14 and lid support 12 allows a tilting movement, film type hinges 50 made of the plastic material of the container are provided in the area of the back wall 20 between the projections 46 protruding from covering wall 24 of the lid support and the projections 45 protruding from the lower side of covering wall 38. These pliable hinges allow tilting of lid 14 from the position shown in FIGS. 3 and 4, which is the one given in the injection molding process into the closed position as shown in FIGS. 4 and 5. The pliable hinges 50 also connect lid 14 and lid support 12 to form an integral unit. Moreover, another integral connection is formed by two springs 52 which are located next to the pliable hinges where they are laterally spaced apart and molded to the back wall of lid support 12 and the corresponding edge of wall 38. In the mold, these springs 52 which have considerably thicker walls than the very thin pliable hinges 50 are formed in the approximately semicircular-circular shape shown in FIG. 3. The arc and the position of the springs 52 with respect to the position of the pliable hinges is selected such that the springs 52 are bent when tilted upward from the position shown in FIG. 3 where they are then extended in an intermediate position. As a consequence of the elastic bending, the springs 52 develop a restoring force that tends to push the lid back into its initial position. On the other hand, the arrangement of the pliable hinge 50 and the spring 52 is also selected such that the restoring force generated by the spring during closing is minimized in the closed position of the lid. Or, after the lid has passed a dead center, the restoring force acts at a lever with respect to the lid tilting axis formed by the pliable hinges, thus generating a momentum that acts in closing direction. In its closed position, the lid is then not only held by the friction of the stopper-like annular wall 36 in the annular wall 32, but also by an additional closing momentum.

Figure 6E:
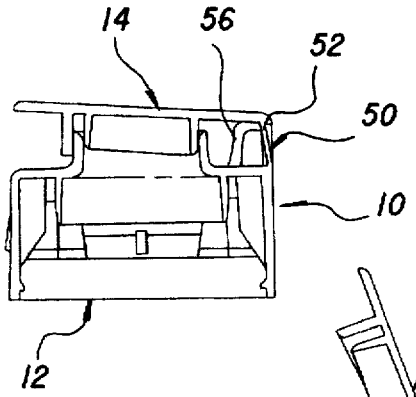
FIGS. 6*a* to 6*e* are sectional views in accordance with FIG. 3 showing the closing device in a reduced scale.
Figure 6D:
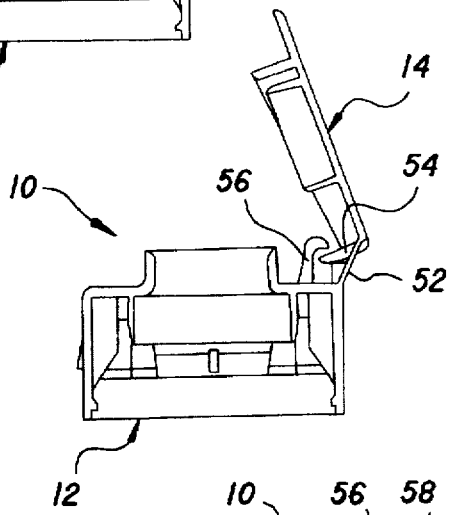
Figure 6C:
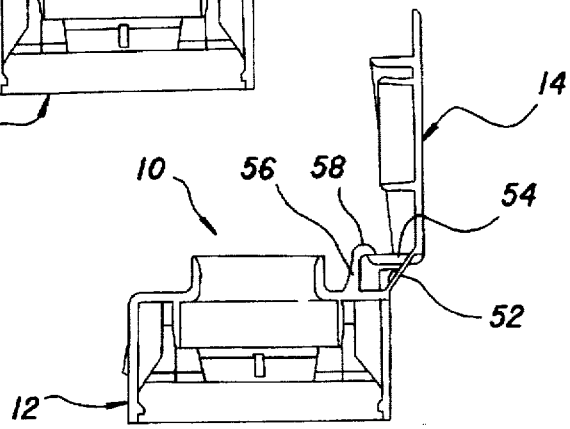
Figure 6B:
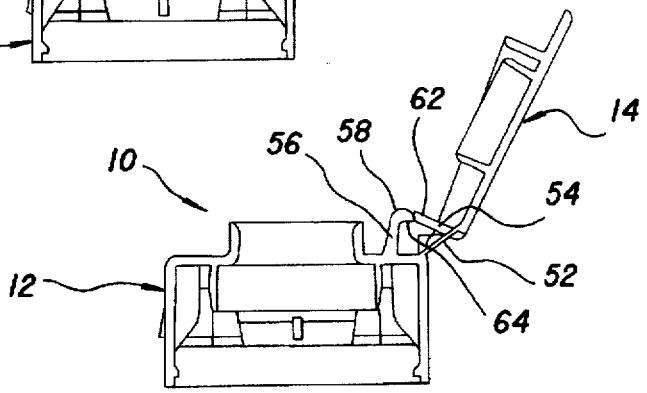
Figure 6A:
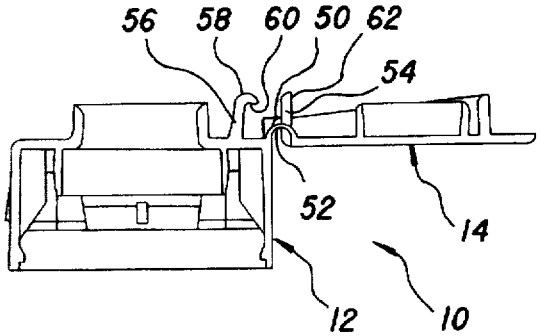
Figure 8:
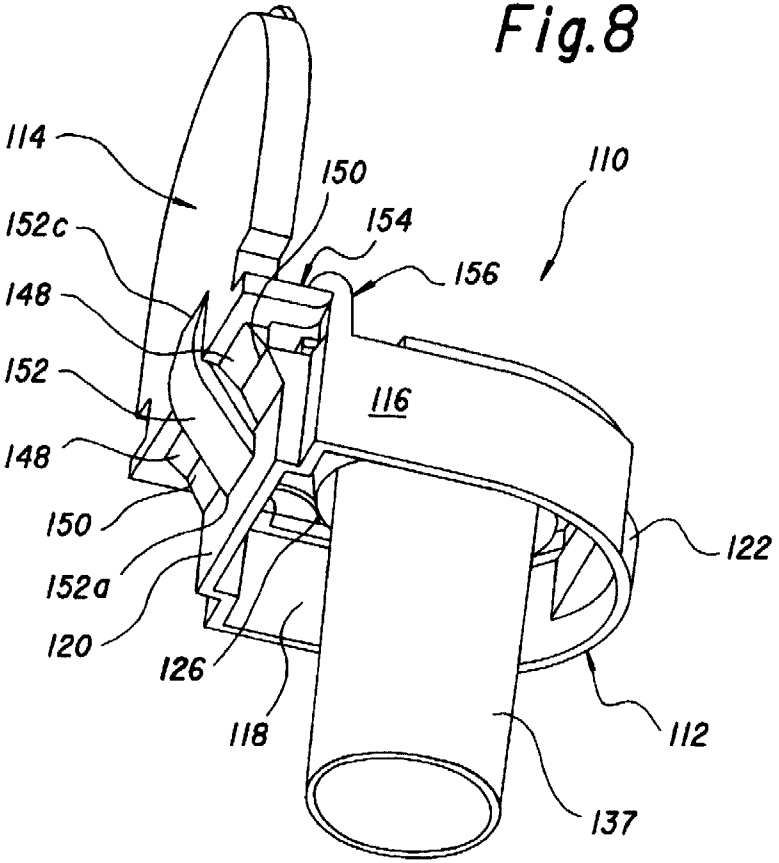
FIG. 8 is a perspective view of the closing device in a different angle, i.e. showing the lid support laterally from the bottom.
Figure 7:
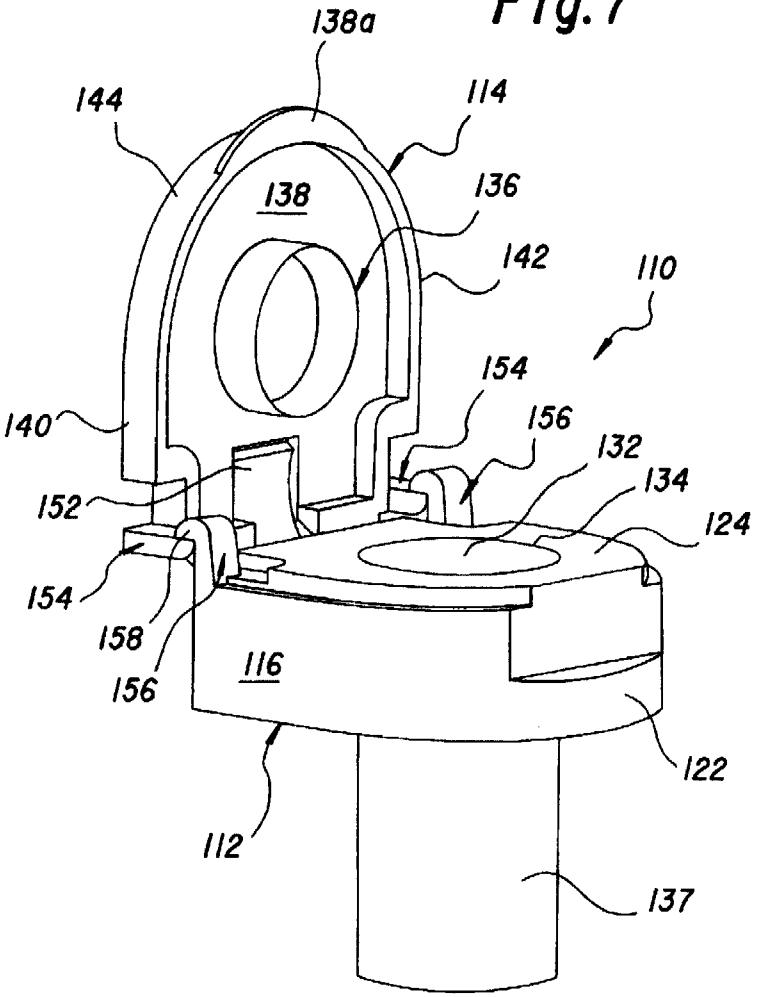
FIG. 7 is a perspective view of a second embodiment of the closing device in accordance with the invention, where the lid is tilted up into the desired open position.
Figure 9:
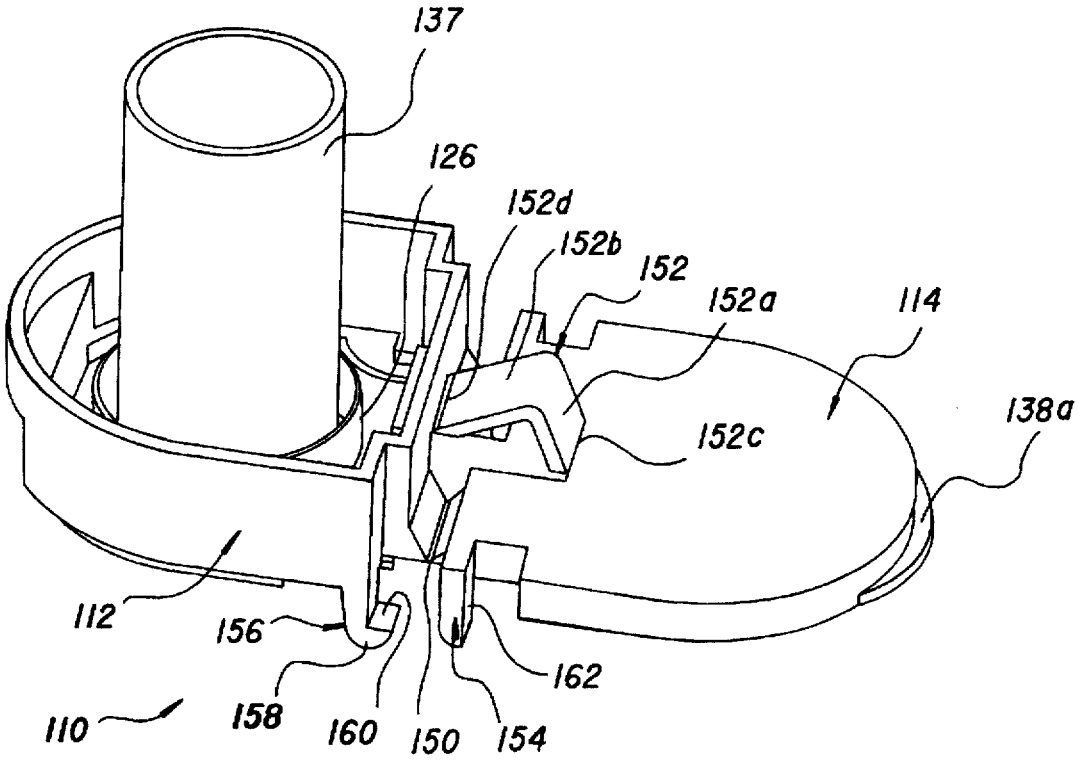
FIG. 9 is a perspective view of the closing device of FIGS. 7 and 8 where the injection-molded lid is shown in an open position which is beyond the desired open position, i.e. tilted up by 180° as compared to the closed position.
Figure 10:
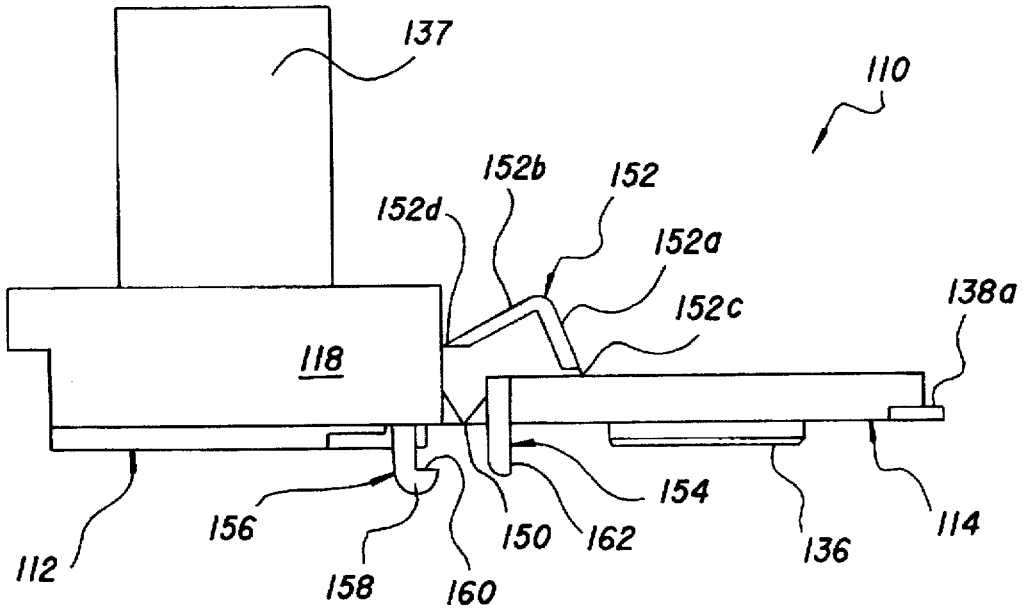
FIG. 10 is a lateral view of the closing device showing the lid position of FIG. 9.

Once the closing device 10 is mounted onto its container, lid 14 should, for the initially stated reasons, kept in a desired open position, which is shown in the embodiment illustrated in FIGS. 1 and 6*c* where it is tilted up by 90° with respect to the closed position. In the closing device in accordance with the invention, this is achieved in that abutment elements are provided which interact at lid support 12 and lid 14. Said abutments allow tilting of lid 14 from its manufacturing position into the closing position, but act as stoppers when the lid is tilted up from the closed position into the desired open position. In the described embodiment, the abutment surfaces act at each other in the desired open position by contacting one another. They are formed at a projection 54 which protrudes at an angle of 90° from the lower side of the back wall and approximately in the center of the edge associated with this back wall on the one side, and the lower side of a hook-like bend 58 at the free end of projection 56 protruding from the covering wall 24 in the vicinity of back wall 20. Both abutments 54 and 56 are integrally molded, functional parts made of the same material as the closing device. Preferably at least one of the abutments 54 and 56 is made such that it can be elastically bent. The surface of the bend opposite the actual contact surface 60 is rounded such that the free end of part 54 slides on this rounded upper sides like on a cam surface where it can also bend abutment 56. The free end of abutment 54 is rounded accordingly. The location of the contact surface 60 and contact surface 62, the latter being formed on the rounded portion of abutment 54 opposite the flat side, is selected such that the lid 14 can be tilted up from the position shown in FIG. 6*a* after injection in the mold, but comes into contact with the rounded upper side of bend 58 (FIG. 6*b*) even before it reaches a desired open position. When the lid is further tilted toward the closed position, the free end of abutment 54 slides on the rounded top side of bend 58 to the free edge of the bend where the abutments 54 and 56 are elastically bent until the desired open position (FIG. 6*c*) is reached. In this position, the free end of abutment 54 passes just beyond the free end of bend 58. The flexible abutment 56 then snaps back over the free end of abutment 54 and the contact surfaces 60 and 62 come to rest before one another. Tilting back in the original position according to FIG. 6*a* is now no longer possible, i.e. lid 14 is kept in the desired open position (FIG. 6*c*). The abutments 56 do, however, not interfere with the continued tilting of the lid in closing direction, as is shown in FIG. 6*d* and 6*e*, as the contacting surfaces 60 and 62 are moved away from each other.

It is obvious that even when parts 54 and 56 are flexible parts, there is no practical risk that the lid tilts back from its desired open position into its initial position since the contact surfaces 60 and 62 which rest again one another in the opening position practically run perpendicularly to the moving in direction of the tilting movement. Even a strong restoring force of the spring 52 does then not generate a force component which may tend to disengage abutments 54 and 65.

The second embodiment of a closing device 110 in accordance with the invention as shown in FIGS. 7 to 10 has basically the same design and functional structure as the above described closing device 10. It may, therefore, suffice to describe only the modifications and improvements whereas all identical configurations may be taken from the above description of the closing device, particularly since identical parts of both closing devices are given the same reference numerals in the drawings, except that a "1" precedes all numerals when reference is made to closing device 110.

In a top view of lid wall 124, the front side of front wall 122 of lid support 112 is no longer planar, but has an arcuate form. This is an adaptation to match another container form. Apart from that, the distance between lid wall 138 and lid wall 124 in the closed position of lid 114 is reduced such that they either contact one another or are spaced apart at a very small distance. Accordingly, orifice 132 in lid wall 124 of lid support 112 is not configured as an annular wall corresponding to the protruding annular wall 32, but as an opening set flush in lid wall 124. Annular wall 136 which forms the stopper engages said opening at the lower side of lid wall 138. A tubular piece 137 which surrounds orifice 132 and projects into the interior of the container is provided at the lower side of lid wall 124. Said tubular piece 137, hence, immerses into the liquid contained in the container thus reducing the surface of the container content that is exposed to ambient air when lid 114 is opened and reducing the chance of chemical changes to the content as a consequence of oxidation and the like.

Instead of the two springs 52 provided in container 10, container 110 has one spring 152 which is centered between pliable hinges 150. Instead of the arcuate form of spring 52, said spring 152 has in the unstressed condition in which it is manufactured in the mold (FIGS. 9 and 10), the form of a bend consisting of two arms 152*a* and 152*b* which are connected to one another to form an angle. The free ends of the two arms 152*a* and 152*b* are not rigid, but integrally linked to the lid wall 138 or the back wall 120 of lid support 112 via pliable hinges 152*c* and 152*d*. Experience has shown that with a so configured spring, i.e. in the form of a bend, it is possible to generate opening and closing forces which ensure that the support of lid 114 is secured in the desired closed or open position.

Figure 11:
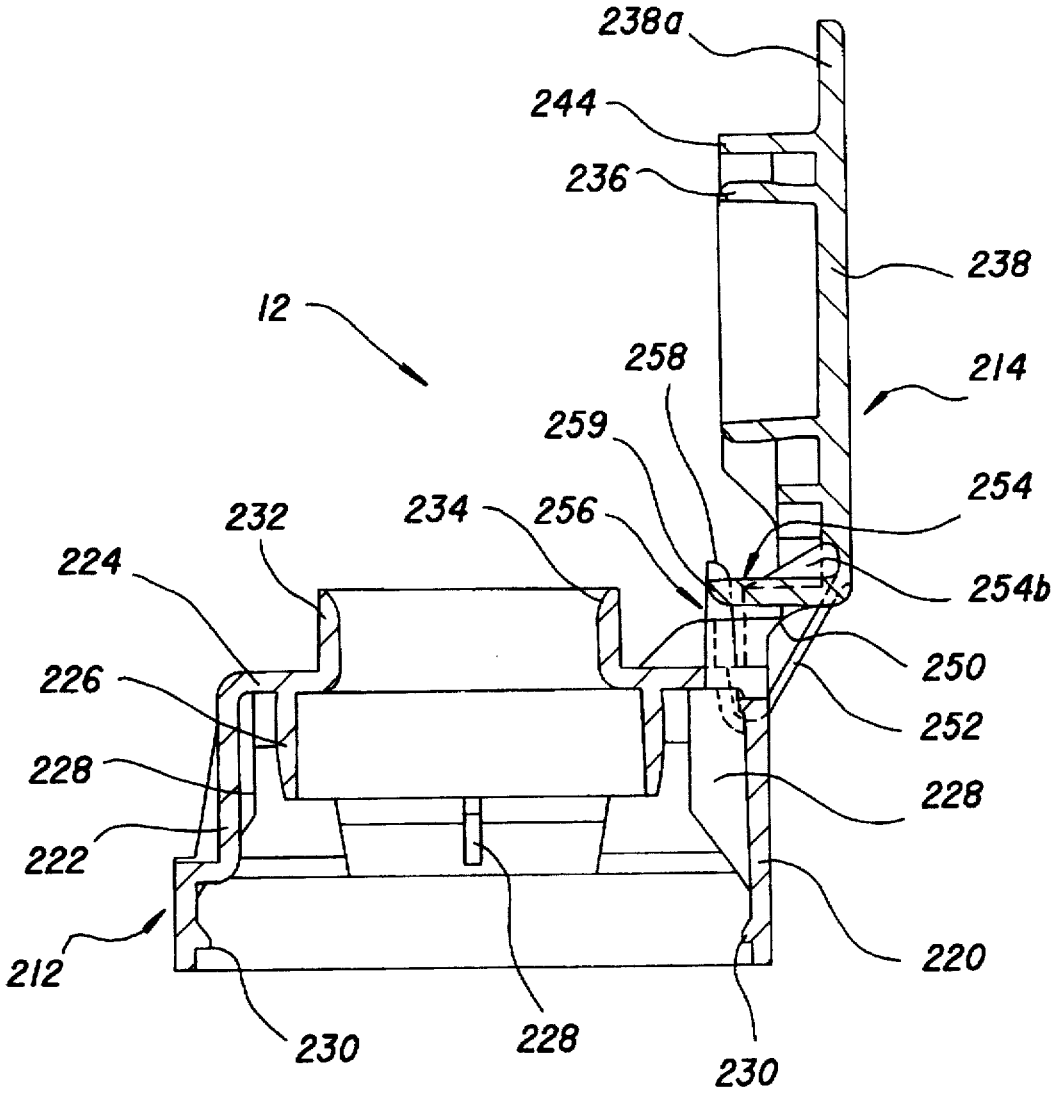
FIG. 11 is a sectional view of a third embodiment, with the section taken as in FIG. 3. The lid is shown in the desired open position.
Figure 12:
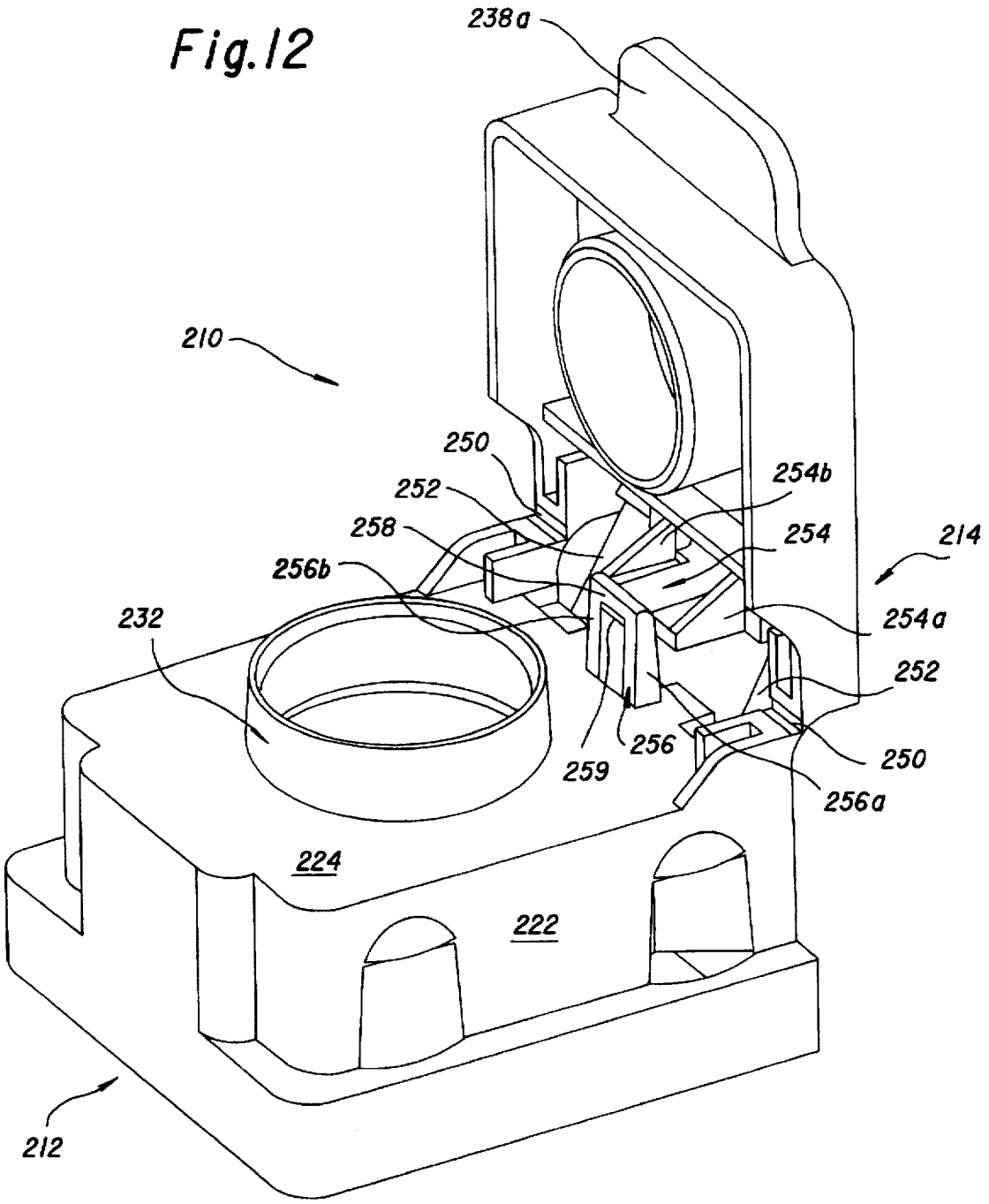
FIG. 12 is a perspective view of a third embodiment showing the area of the link as seen in direction of arrow 12 in FIG. 11.

As compared to the described container closing devices 10 and 110, FIGS. 11 and 12 show a third embodiment of a container closing device 210. In this embodiment, the abutments which secure the lid in a desired open position against further opening, have a different configuration. The following description refers only to the modifications, whereas the remaining configuration corresponds to the already described embodiments. All functional parts in FIGS. 11 and 12 are designated with the same reference numerals as in the first embodiment, except that all numbers are preceded by a "2".

In this case, the abutment 254 protruding from the lid wall 238 of lid 214 is reinforced so as to be practically rigid by means of two slanted ribs 254*a*, 254*b* which are molded thereto at its edge. The contact surface corresponding to the contact surface 60 of abutment 54 of closing device 10 is here configured at a projection 259 which projects from the edge of abutment 254 facing away from the lid. This projection 259 is also reduced in its width.

With respect to function, this flexible abutment 256 corresponds to abutment 56 in the first embodiment. It has, however, two laterally spaced apart sections 256*a* and 256*b* which protrude from lid wall 224. The free ends of these sections are connected via a cross bar 258 which replaces the hook-like bend 58 of the first embodiment. The corresponding contact surface is configured at the lower side of this cross bar.

The top sides of the abutments 254 and the cross bar 258 which are opposite the contact surfaces are rounded to achieve the already described effect that when the lid 214 is tilted from the mold position into closed position, said rounded surfaces come into contact with each other. This generates a component of the closing force that exerts pressure onto lid 214 which bends the rod-like sections 256*a* and 256*b* such that the cross bar is displaced and projection 259 protrudes past the cross bar 258. As soon as the projection is located beneath cross bar 258, the rod-like sections 256*a* and 256*b* spring back and the contact surfaces at the two pieces come to rest against one another. As these contact surfaces assume a normal position with respect to each other, a force which is exerted into opening direction of the lid cannot snap the abutments out of position as a force component which bends the flexible rod-like sections 256*a* and 256*b* is not generated. Undesired bending of lid 214 in a position past the desired open position of the lid is, hence, further prevented as compared to the above described embodiments.

It is obvious that of the teaching of this invention also allows modifications and improvement of the above embodiments.

It is, therefore, basically possible to provide the design of the invention even without lid support directly at a plastic container.

The—preferred—pliable hinges may also be omitted if provision is made for further functional components connecting the lid at the lid support so that it can be moved on a defined tilting axis. Possible solutions include pivots which are molded to the lid or the lid support and snap into corresponding recesses, once the molding process is completed. However, as such a configuration requires an additional assembly step to snap the pivot into the corresponding recesses, the use of pliable hinges is preferred.

Owing to the described special configuration of the closing device in accordance with the invention, it is possible that these closing devices can be opened both manually and automatically. When opened automatically in analyzers, there is no risk that the lid of a closing device may be coincidentally tilted into a position that interferes with the automatic introduction and removal of filling nozzles or pipettes. A desirable configuration for the lid, lid support, and springs, is one where a desirable angle for the lid to be held at, with respect to the lid support, is 90°. In such a configuration, at angles of less than, for example, 80°, the spring biases the lid toward the closed position. At angles higher than 80°, the spring biases the lid in an opened direction, thereby forcing the stopping abutments into contact, and maintaining the lid at a 90° with respect to the lid support. 80°, therefore, could be considered to be a "dead center position", where the biasing force of the spring may be zero. Below the dead center position, the biasing force could be toward the closed position; above the dead center position, the biasing force could be toward the opened position.

We claim:

1. A closing device for containers, said closing device comprising:

a lid having a first stopping abutment protruding therefrom;

a lid support hingably connected to said lid, said lid support including a second stopping abutment thereupon, said second stopping abutment on said lid support being disposed to engage said first stopping abutment on said lid when said lid is in an opened position;

spring means disposed between said lid and said lid support, said spring means being configured to urge said lid toward a closed position with respect to said lid support when an angle between the lid and the lid support is smaller than an angle at which the spring means is at a dead center position, said spring means urging said first stopping abutment on said lid into contact with said second stopping abutment on said lid support in an opening direction of said lid, defining an open position, when the angle between the lid and the lid support is larger than the angle at which the spring means is at the dead center position, wherein said first and second stopping abutments have respective first and second contact surfaces, and wherein a force from the spring means acting upon the lid to swing the lid beyond the dead center position, to said open position, generates a reactive force in a direction which is perpendicular to planes of the contact surfaces.

2. A closing device as recited in claim 1, wherein at least one of said first and second stopping abutments is sufficiently flexible so as to be elastically displaced by another of the first and second stopping abutments during a pivoting motion of said lid relative to said lid support when said lid is closed for a first time, said at least one stopping abutment elastically returning to an original position thereof.

3. A closing device as recited in claim 1, wherein said lid and said lid support are hingably connected by at least one integrally formed pliable hinge.

4. A closing device as recited in claim 1, wherein said first stopping abutment on said lid includes at least one rib, said rib reinforcing said first stopping abutment, and facing away from a surface of said first stopping abutment which engages said second stopping abutment.

5. A closing device as recited in claim 1, wherein said second stopping abutment on said lid support comprises two spatially separated rod-like sections protruding upwardly from said lid support, with distal ends of said two rod-like portions being connected via a cross bar, with a lower portion of the cross bar being configured to engage said first stopping abutment.

6. A closing device as recited in claim 1, wherein said spring means and said first and second stopping abutments are configured such that when a force is applied to the lid when being closed for a first time, the first stopping abutment on the lid and the second stopping abutment on the lid support are displaced relative to each other.

7. A closing device as recited in claim 1, wherein said first and second stopping abutments are configured to engage each other and support said lid at a predetermined angle between 80° and 100°, with respect to a fully closed position.

8. A closing device as recited in claim 1, wherein said closing device comprises a plastic material.

9. A closing device as recited in claim 8, wherein said plastic material comprises one material of the group consisting of polyethylene, polypropylene, polyoximethylene, polyethyleneterephthalate, polybutylenterephthalate, and styrene butadien copolymers.

10. A closing device as recited in claim 9, wherein said closing device comprises an injection molded material.

11. A closing device as recited in claim 1, wherein said lid includes an upper side and a lower side thereof, said lower side of the lid facing the lid support, and including a projection which is configured to pressingly engage an orifice in the lid support, thereby sealing said orifice.

12. A closing device as recited in claim 11, wherein said projection in said lid comprises an annular wall having a curved outer periphery, said curved outer periphery having a diameter which exceeds a diameter of the orifice in the lid support.

13. A closing device as recited in claim 12, wherein said annular wall flares outwardly from a lower surface of said lid, such that the diameter of the curved outer periphery is wider than a diameter of said annular wall at a position immediately adjacent said lid.

14. A closing device as recited in claim 12, wherein an inner diameter of the annular wall is at least 8 mm.

15. A closing device as recited in claim 1, wherein said spring means is a pliable spring which is integrally formed with at least one of the lid and the lid support.

16. A closing device as recited in claim 15, wherein said spring means comprises two laterally spaced spring elements, said spring elements being disposed on a vertical plane which is perpendicular to a tilting axis of the lid, said two spring elements being disposed on opposite sides of said closing device.

17. A closing device according to claim 15, wherein said lid support is integrally provided on a container.

18. A closing device for containers, said closing device comprising:

a lid having a first stopping abutment protruding therefrom;

a lid support hingably connected to said lid, said lid support including a second stopping abutment thereupon, said second stopping abutment on said lid support being disposed to engage said first stopping abutment on said lid when said lid is in an opened position;

spring means disposed between said lid and said lid support, said spring means being configured to urge said lid toward a closed position with respect to said lid support when an angle between the lid and the lid support is smaller than an angle at which the spring means is at a dead center position, said spring means urging said first stopping abutment on said lid into contact with said second stopping abutment on said lid support in an opening direction of said lid when the angle between the lid and the lid support is larger than the angle at which the spring means is at the dead center position, wherein said spring means is a pliable spring which comprises an arcuate leaf spring having a first end integrally molded to the lid, and a second end integrally molded to the lid support.

19. A closing device for containers, said closing device comprising:

a lid having a first stopping abutment protruding therefrom;

a lid support hingably connected to said lid, said lid support including a second stopping abutment thereupon, said second stopping abutment on said lid support being disposed to engage said first stopping abutment on said lid when said lid is in an opened position;

spring means disposed between said lid and said lid support, said spring means being configured to urge said lid toward a closed position with respect to said lid support when an angle between the lid and the lid support is smaller than an angle at which the spring means is at a dead center position, said spring means urging said first stopping abutment on said lid into contact with said second stopping abutment on said lid support in an opening direction of said lid when the angle between the lid and the lid support is larger than the angle at which the spring means is at the dead center position, wherein at least one of said first and second stopping abutments comprises a hook having a contact surface at one side thereof, said contact surface for engaging another of the first and second stopping abutments.

20. A closing device as recited in claim 19, wherein said contact surface is configured to be perpendicular to a bending plane of the another of the first and second stopping abutments.

21. A closing device for containers, said closing device comprising:

a lid having a first stopping abutment protruding therefrom;

a lid support hingably connected to said lid, said lid support including a second stopping abutment thereupon, said second stopping abutment on said lid support being disposed to engage said first stopping abutment on said lid when said lid is in an opened position;

spring means disposed between said lid and said lid support, said spring means being configured to urge said lid toward a closed position with respect to said lid support when an angle between the lid and the lid support is smaller than an angle at which the spring means is at a dead center position, said spring means urging said first stopping abutment on said lid into contact with said second stopping abutment on said lid support in an opening direction of said lid when the angle between the lid and the lid support is larger than the angle at which the spring means is at the dead center position, wherein said spring means is a pliable spring which is integrally formed with at least one of the lid and the lid support, and wherein said spring means comprises two planar portions being integrally coupled to each other along a common edge.

22. A closing device for containers, said closing device, comprising:

cover means for closing a container, said cover means having first stopping means protruding therefrom;

cover support means hingably connected to said cover means, said cover support means including a second stopping means thereupon, said second stopping means on said cover support means being configured to engage said first stopping means when said cover means is in an opened position;

biasing means disposed between said cover means and said cover support means, said biasing means being configured to urge said cover means toward a closed position with respect to said cover support means, when an angle between the cover means and the cover support means is smaller than an angle at which the biasing means is at a dead center position, said biasing means urging said first stopping means on said cover means into contact with said second stopping means on said cover support means, in an opening direction of said cover means, defining an open position when the angle between the cover means and the cover support means is larger than the angle at which the biasing means is at the dead center position, wherein said first and second stopping abutments have respective first and second contact surfaces, and wherein a force, from the biasing means acting upon the lid to swing the lid beyond the dead center position, to said open position generates a reactive force in a direction which is perpendicular to planes of the contact surfaces.

* * * * *